US010780705B2

(12) United States Patent
McGuinness et al.

(10) Patent No.: US 10,780,705 B2
(45) Date of Patent: Sep. 22, 2020

(54) FLUID EJECTION DEVICE

(71) Applicant: HEWLETT-PACKARD DEVELOPMENT COMPANY, L.P., Fort Collins, CO (US)

(72) Inventors: Nicholas McGuinness, San Diego, CA (US); Alexander Govyadinov, Corvallis, OR (US); Tsuyoshi Yamashita, Corvallis, OR (US); Erik D Torniainen, Corvallis, OR (US); David P Markel, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/095,478

(22) PCT Filed: Jul. 29, 2016

(86) PCT No.: PCT/US2016/044833
§ 371 (c)(1),
(2) Date: Oct. 22, 2018

(87) PCT Pub. No.: WO2018/022105
PCT Pub. Date: Feb. 1, 2018

(65) Prior Publication Data
US 2019/0134987 A1 May 9, 2019

(51) Int. Cl.

| | |
|---|---|
| ***B41J 2/18*** | (2006.01) |
| ***B41J 2/14*** | (2006.01) |
| ***B41J 2/175*** | (2006.01) |

(52) U.S. Cl.
CPC ..... *B41J 2/18* (2013.01); *B41J 2/1404* (2013.01); *B41J 2/14032* (2013.01); *B41J 2/175* (2013.01); *B41J 2002/14467* (2013.01); *B41J 2202/12* (2013.01)

(58) Field of Classification Search
None
See application file for complete search history.

(56) References Cited

U.S. PATENT DOCUMENTS

| | | | |
|---|---|---|---|
| 5,097,275 | A | 3/1992 | Takita |
| 7,429,100 | B2 | 9/2008 | Pechtl |
| 7,431,432 | B2 | 10/2008 | Worsman et al. |
| 7,484,836 | B2 | 2/2009 | Moynihan |

(Continued)

FOREIGN PATENT DOCUMENTS

| | | |
|---|---|---|
| CN | 102310656 | 1/2012 |
| CN | 103442896 | 12/2013 |

(Continued)

*Primary Examiner* — Erica S Lin
(74) *Attorney, Agent, or Firm* — Middleton Reutlinger

(57) ABSTRACT

A fluid ejection device includes a fluid slot, two laterally adjacent fluid ejection chambers each having a drop ejecting element therein, a fluid circulation path communicated with the fluid slot and each of the two laterally adjacent fluid ejection chambers, and a fluid circulating element within the fluid circulation path, with the fluid circulating element laterally adjacent at least one of the two laterally adjacent fluid ejection chambers, and the two laterally adjacent fluid ejection chambers to substantially simultaneously eject drops of fluid therefrom such that the drops of fluid are to coalesce during flight.

10 Claims, 6 Drawing Sheets

(56) References Cited

U.S. PATENT DOCUMENTS

| | | | | |
|---|---|---|---|---|
| 7,604,327 | B2 | 10/2009 | Sugahara | |
| 7,753,496 | B2 | 7/2010 | Silverbrook | |
| 8,033,650 | B2 | 2/2011 | Xie | |
| 8,833,909 | B2 | 9/2014 | Nishitani | |
| 2010/0208003 | A1 | 8/2010 | Silverbrook | |
| 2011/0007105 | A1 | 1/2011 | Kuribayashi et al. | |
| 2011/0234669 | A1 | 9/2011 | Trudy et al. | |
| 2011/0316918 | A1* | 12/2011 | Nagashima | B41J 2/14233 347/12 |
| 2013/0057622 | A1* | 3/2013 | Govyadinov | B41J 2/1404 347/85 |
| 2013/0155135 | A1* | 6/2013 | Govyadinov | B41J 2/14129 347/10 |
| 2013/0155152 | A1 | 6/2013 | Govyadinov et al. | |
| 2013/0278688 | A1 | 10/2013 | Bibl | |

FOREIGN PATENT DOCUMENTS

| | | | |
|---|---|---|---|
| JP | 2013544678 | | 12/2013 |
| JP | 2014504975 | | 2/2014 |
| WO | WO-2014007814 | | 9/2014 |
| WO | WO-2016068909 | A1 | 5/2016 |

* cited by examiner

FLUID EJECTION DEVICE

BACKGROUND

Fluid ejection devices, such as printheads in inkjet printing systems, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
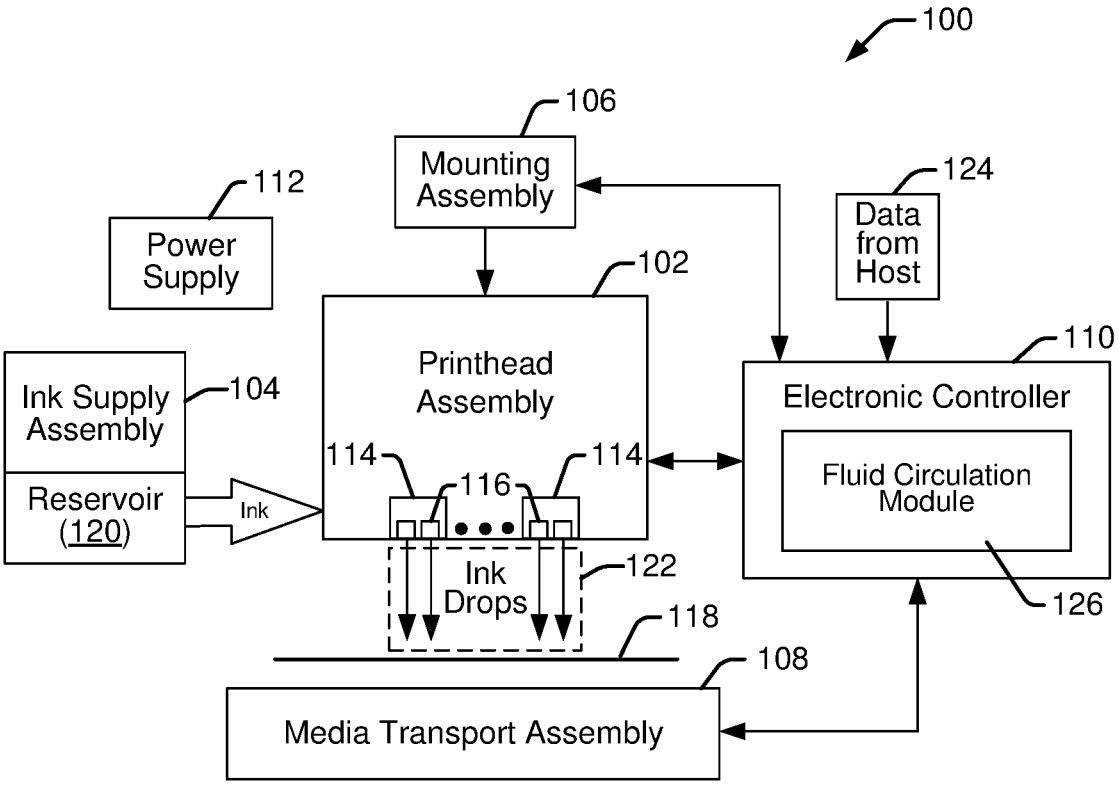
FIG. 1 is a block diagram illustrating one example of an inkjet printing system including an example of a fluid ejection device.

FIG. 1 illustrates one example of an inkjet printing system as an example of a fluid ejection device with fluid circulation, as disclosed herein. Inkjet printing system 100 includes a printhead assembly 102, an ink supply assembly 104, a mounting assembly 106, a media transport assembly 108, an electronic controller 110, and at least one power supply 112 that provides power to the various electrical components of inkjet printing system 100. Printhead assembly 102 includes at least one fluid ejection assembly 114 (printhead 114) that ejects drops of ink through a plurality of orifices or nozzles 116 toward a print medium 118 so as to print on print media 118.

Print media 118 can be any type of suitable sheet or roll material, such as paper, card stock, transparencies, Mylar, and the like, and may include rigid or semi-rigid material, such as cardboard or other panels. Nozzles 116 are typically arranged in one or more columns or arrays such that properly sequenced ejection of ink from nozzles 116 causes characters, symbols, and/or other graphics or images to be printed on print media 118 as printhead assembly 102 and print media 118 are moved relative to each other.

Ink supply assembly 104 supplies fluid ink to printhead assembly 102 and, in one example, includes a reservoir 120 for storing ink such that ink flows from reservoir 120 to printhead assembly 102. Ink supply assembly 104 and printhead assembly 102 can form a one-way ink delivery system or a recirculating ink delivery system. In a one-way ink delivery system, substantially all of the ink supplied to printhead assembly 102 is consumed during printing. In a recirculating ink delivery system, only a portion of the ink supplied to printhead assembly 102 is consumed during printing. Ink not consumed during printing is returned to ink supply assembly 104.

In one example, printhead assembly 102 and ink supply assembly 104 are housed together in an inkjet cartridge or pen. In another example, ink supply assembly 104 is separate from printhead assembly 102 and supplies ink to printhead assembly 102 through an interface connection, such as a supply tube. In either example, reservoir 120 of ink supply assembly 104 may be removed, replaced, and/or refilled. Where printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters.

Printhead assembly 102 includes one or more printheads 114. In one example, printhead assembly 102 is a wide-array or multi-head printhead assembly. In one implementation of a wide-array assembly, printhead assembly 102 includes a carrier that carries a plurality of printheads 114, provides electrical communication between printheads 114 and electronic controller 110, and provides fluidic communication between printheads 114 and ink supply assembly 104.

In one example, inkjet printing system 100 is a drop-on-demand thermal inkjet printing system wherein printhead 114 is a thermal inkjet (TIJ) printhead. The thermal inkjet printhead implements a thermal resistor ejection element in an ink chamber to vaporize ink and create bubbles that force ink or other fluid drops out of nozzles 116. In another example, inkjet printing system 100 is a drop-on-demand piezoelectric inkjet printing system wherein printhead 114 is a piezoelectric inkjet (PIJ) printhead that implements a piezoelectric material actuator as an ejection element to generate pressure pulses that force ink drops out of nozzles 116.

In one example, electronic controller 110 includes a flow circulation module 126 stored in a memory of controller 110. Flow circulation module 126 executes on electronic controller 110 (i.e., a processor of controller 110) to control the operation of one or more fluid actuators integrated as pump elements within printhead assembly 102 to control circulation of fluid within printhead assembly 102.

Figure 2:
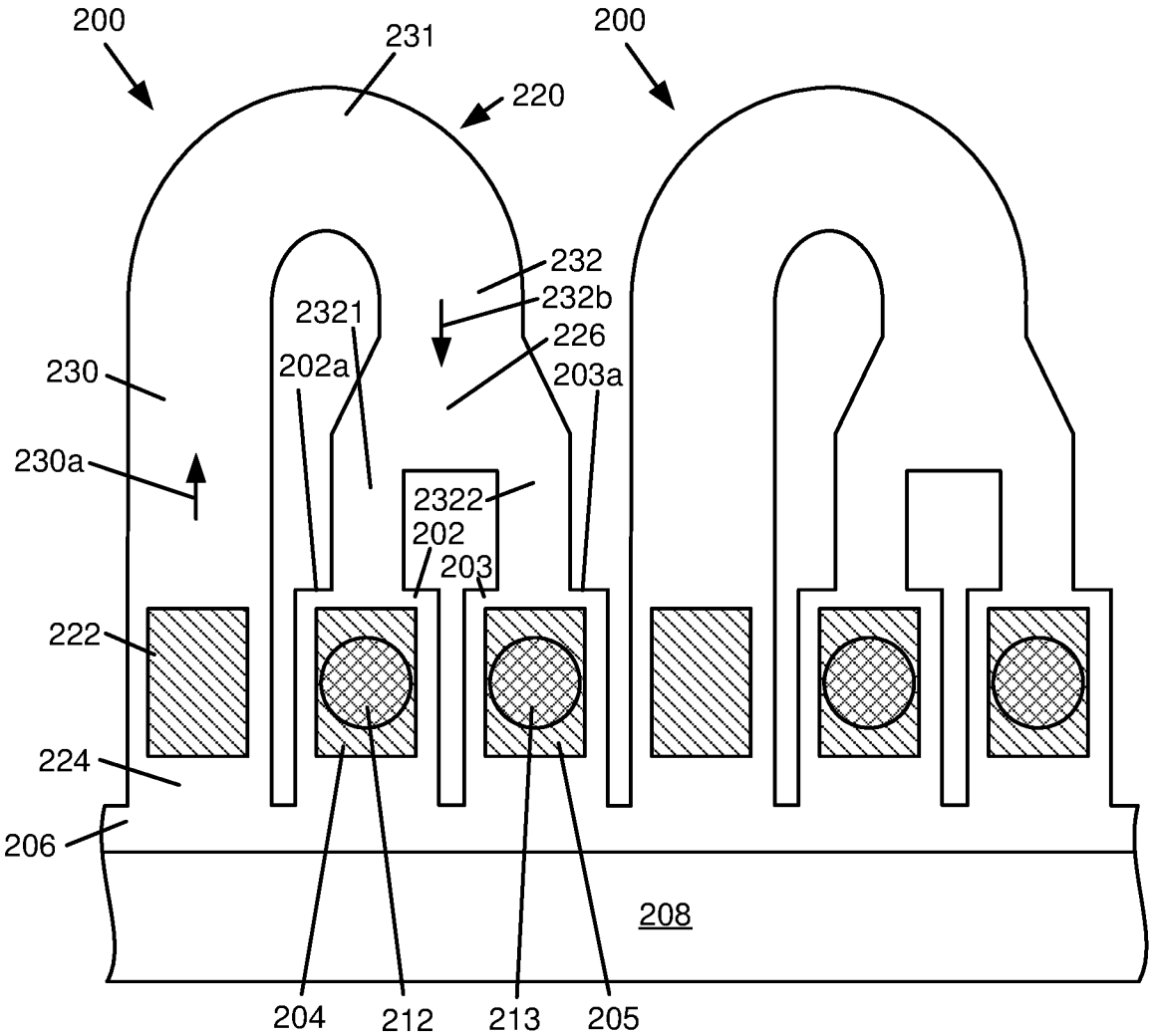
FIG. 2 is a schematic plan view illustrating an example of a portion of a fluid ejection device.

FIG. 2 is a schematic plan view illustrating an example of a portion of a fluid ejection device 200. Fluid ejection device 200 includes a first fluid ejection chamber 202 and a corresponding drop ejecting element 204 formed in, provided within, or communicated with fluid ejection chamber 202, and a second fluid ejection chamber 203 and a corresponding drop ejecting element 205 formed in, provided within, or communicated with fluid ejection chamber 203.

In one example, fluid ejection chambers 202 and 203 and drop ejecting elements 204 and 205 are formed on a substrate 206 which has a fluid (or ink) feed slot 208 formed therein such that fluid feed slot 208 provides a supply of fluid (or ink) to fluid ejection chambers 202 and 203 and drop ejecting elements 204 and 205. Fluid feed slot 208 includes, for example, a hole, passage, opening, convex geometry or other fluidic architecture formed in or through substrate 206 by which or through which fluid is supplied to fluid ejection chambers 202 and 203. Fluid feed slot 208 may include one (i.e., a single) or more than one (e.g., a series of) such hole, passage, opening, convex geometry or other fluidic architecture that communicates fluid with one (i.e., a single) or more than one fluid ejection chamber, and may be of circular, non-circular, or other shape. Substrate 206 may be formed, for example, of silicon, glass, or a stable polymer.

In one example, fluid ejection chambers 202 and 203 are formed in or defined by a barrier layer (not shown) provided on substrate 206, such that fluid ejection chambers 202 and 203 each provide a "well" in the barrier layer. The barrier layer may be formed, for example, of a photoimageable epoxy resin, such as SU8. In one example, a nozzle or orifice layer (not shown) is formed or extended over the barrier layer such that nozzle openings or orifices 212 and 213 formed in the orifice layer communicate with respective fluid ejection chambers 202 and 203.

In one example, as illustrated in FIG. 2, nozzle openings or orifices 212 and 213 are of the same size and shape. Nozzle openings or orifices 212 and 213 may be of a circular, non-circular, or other shape. Although illustrated as being of the same size, nozzle openings or orifices 212 and 213 may be of different sizes (for example, different diameters, effective diameters, or maximum dimensions). Although illustrated as being of the same shape, nozzle openings or orifices 212 and 213 may be of different shapes (for example, one circular, one non-circular). In addition, although illustrated as being of the same shape and same size, drop ejecting elements 204 and 205 and corresponding fluid ejection chambers 202 and 203 may be of different shapes, and may be of different sizes.

Drop ejecting elements 204 and 205 can be any device capable of ejecting fluid drops through corresponding nozzle openings or orifices 212 and 213. Examples of drop ejecting elements 204 and 205 include thermal resistors or piezoelectric actuators. A thermal resistor, as an example of a drop ejecting element, may be formed on a surface of a substrate (substrate 206), and may include a thin-film stack including an oxide layer, a metal layer, and a passivation layer such that, when activated, heat from the thermal resistor vaporizes fluid in corresponding fluid ejection chamber 202 or 203, thereby causing a bubble that ejects a drop of fluid through corresponding nozzle opening or orifice 212 or 213. A piezoelectric actuator, as an example of a drop ejecting element, generally includes a piezoelectric material provided on a moveable membrane communicated with corresponding fluid ejection chamber 202 or 203 such that, when activated, the piezoelectric material causes deflection of the membrane relative to corresponding fluid ejection chamber 202 or 203, thereby generating a pressure pulse that ejects a drop of fluid through corresponding nozzle opening or orifice 212 or 213.

As illustrated in the example of FIG. 2, fluid ejection device 200 includes a fluid circulation path or channel 220 and a fluid circulating element 222 formed in, provided within, or communicated with fluid circulation channel 220. Fluid circulation channel 220 is open to and communicates at one end 224 with fluid feed slot 208 and is open to and communicates at another end 226 with fluid ejection chamber 202 and fluid ejection chamber 203. In one example, end 226 of fluid circulation channel 220 communicates with fluid ejection chamber 202 at an end **202*a* of fluid ejection chamber 202 and communicates with fluid ejection chamber 203 at an end 203*a* of fluid ejection chamber 203**.

In one example, fluid circulating element 222 is provided in, provided along, or communicated with fluid circulation channel 220 between end 224 and end 226. More specifically, in one example, fluid circulating element 222 is provided in, provided along, or communicated with fluid circulation channel 220 adjacent end 224. In one example, and as further described below, fluid circulating element 222 is laterally adjacent fluid ejection chamber 202, and fluid ejection chamber 202 is laterally adjacent fluid ejection chamber 203. In other examples, a position of fluid circulating element 222 may vary along fluid circulation channel 220.

Fluid circulating element 222 forms or represents an actuator to pump or circulate (or recirculate) fluid through fluid circulation channel 220. As such, fluid from fluid feed slot 208 circulates (or recirculates) through fluid circulation channel 220 and fluid ejection chambers 202 and 203 based on flow induced by fluid circulating element 222. In one example, circulating (or recirculating) fluid through fluid ejection chambers 202 and 203 helps to reduce ink blockage and/or clogging in fluid ejection device 200.

In the example illustrated in FIG. 2, drop ejecting elements 204 and 205 and fluid circulating element 222 are each thermal resistors. Each of the thermal resistors may include, for example, a single resistor, a split resistor, a comb resistor, or multiple resistors. A variety of other devices, however, can also be used to implement drop ejecting elements 204 and 205 and fluid circulating element 222 including, for example, a piezoelectric actuator, an electrostatic (MEMS) membrane, a mechanical/impact driven membrane, a voice coil, a magneto-strictive drive, and so on.

In one example, fluid circulation channel 220 includes a path or channel portion 230 communicated with fluid feed slot 208, and a path or channel portion 232 communicated with fluid ejection chamber 202 and fluid ejection chamber 203. More specifically, in one example, path or channel portion 232 includes a section or segment 2321 communicated with fluid ejection chamber 202 and a section for segment 2322 communicated with fluid ejection chamber 203. As such, in one example, fluid in fluid circulation channel 220 circulates (or recirculates) between fluid feed slot 208 and fluid ejection chambers 202 and 203 through channel portion 230 and channel portion 232, including through segments 2321 and 2322.

In one example, fluid circulation channel 220 forms a fluid circulation (or recirculation) loop between fluid feed slot 208 and fluid ejection chambers 202 and 203. For example, fluid from fluid feed slot 208 circulates (or recirculates) through fluid ejection chamber 202 and through fluid ejection chamber 203 back to fluid feed slot 208. More specifically, fluid from fluid feed slot 208 circulates (or recirculates) through channel portion 230, through channel portion 232, including through segments 2321 and 2322, and through fluid ejection chamber 202 and fluid ejection chamber 203 back to fluid feed slot 208.

As illustrated in the example of FIG. 2, fluid circulating element 222 is formed in, provided within, or communicated with channel portion 230 of fluid circulation channel 220. As such, in one example, channel portion 230 directs fluid in a first direction, as indicated by arrow 230*a*, and channel portion 232 directs fluid in a second direction opposite the first direction, as indicated by arrow 232*b*. More specifically, in one example, fluid circulation channel 220 directs fluid in a first direction (arrow 230*a*) between fluid feed slot 208 and fluid ejection chambers 202 and 203, and directs fluid in a second direction (arrow 232*b*) opposite the first direction between fluid feed slot 208 and fluid ejection chambers 202 and 203. Thus, in one example, fluid circulating element 222 creates an average or net fluid flow in fluid circulation channel 220 between fluid feed slot 208 and fluid ejection chambers 202 and 203.

In one example, to provide fluid flow in the first direction indicated by arrow 230*a* and the second, opposite direction indicated by arrow 232*b*, fluid circulation channel 220 includes a channel loop 231. As such, in one example, fluid circulation channel 220 directs fluid in the first direction (arrow 230*a*) between fluid feed slot 208 and channel loop 231, and in the second direction (arrow 232*b*) between channel loop 231 and fluid ejection chambers 202 and 203. In one example, channel loop 231 includes a U-shaped portion of fluid circulation channel 220 such that a length (or portion) of channel portion 230 and a length (or portion) of channel portion 232 are spaced from and oriented substantially parallel with each other.

In one example, as illustrated in FIG. 2, a width of segment 2321 of channel portion 232 and a width of segment 2322 of channel portion 232 are each less than a width of channel portion 230. Furthermore, a width of segment 2321 is less than a width of fluid ejection chamber 202, and a width of segment 2322 is less than a width of fluid ejection chamber 203. In other examples, channel portions 230 and 232 (including sections, segments or regions thereof) may be of different widths, and may be of different lengths.

As illustrated in the example of FIG. 2, an array or series of fluid ejection devices 200 is provided along a length of fluid feed slot 208. More specifically, one fluid ejection device 200 including fluid circulation path 220 with corresponding fluid circulating element 222, fluid ejection chamber 202 with corresponding drop ejecting element 204, and fluid ejection chamber 203 with corresponding drop ejecting element 205 is laterally adjacent another fluid ejection device 200 including fluid circulation path 220 with corresponding fluid circulating element 222, fluid ejection chamber 202 with corresponding drop ejecting element 204, and fluid ejection chamber 203 with corresponding drop ejecting element 205 along one side of fluid feed slot 208. In one example, fluid ejection devices 200 are arranged on opposite sides of fluid feed slot 208 such that corresponding nozzle openings or orifices 212 and 213 of fluid ejection devices 200 are arranged in parallel (substantially parallel) columns (or arrays).

Figure 3:
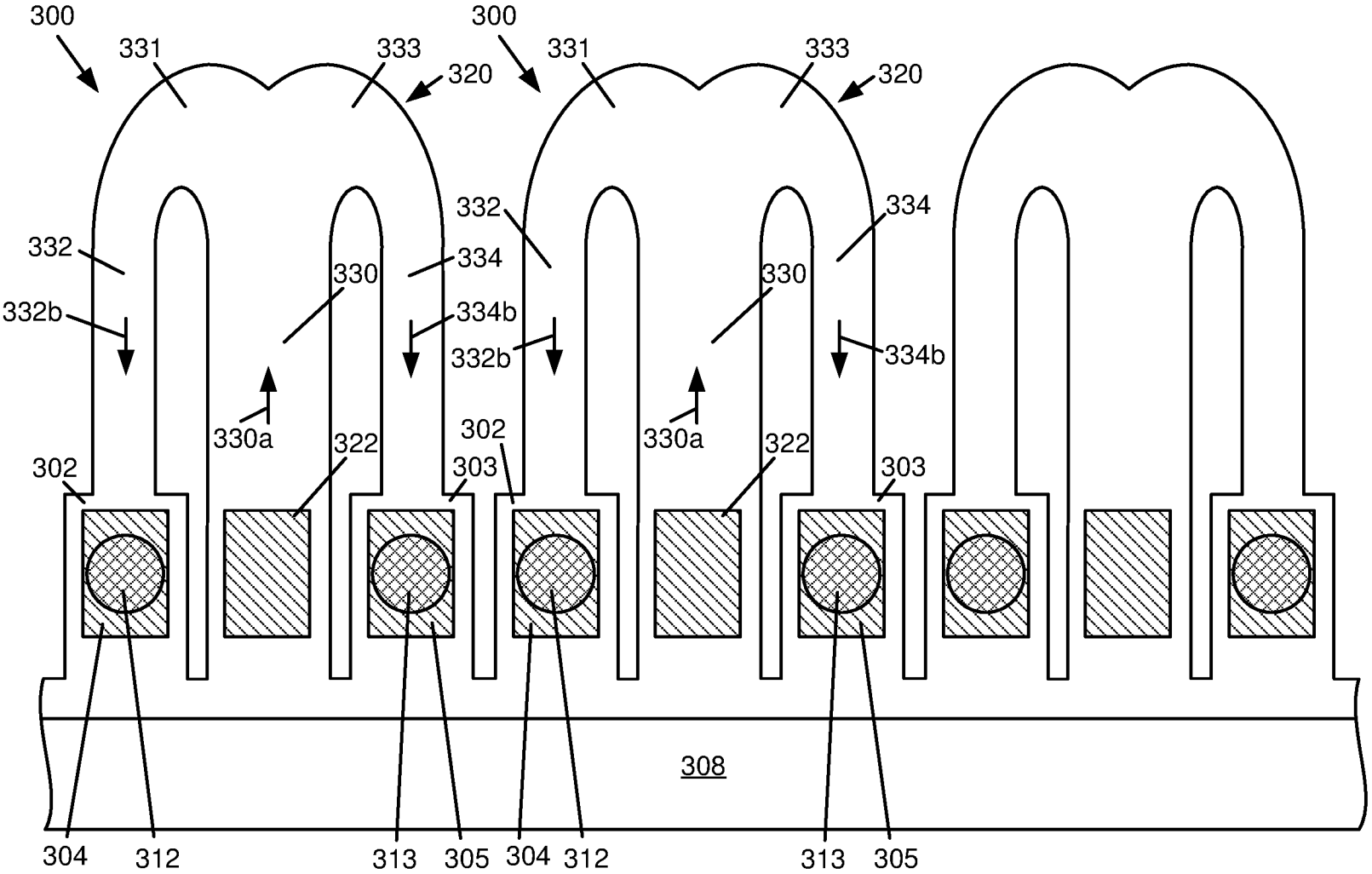
FIG. 3 is a schematic plan view illustrating an example of a portion of a fluid ejection device.

FIG. 3 is a schematic plan view illustrating an example of a portion of a fluid ejection device 300. Similar to fluid ejection device 200, fluid ejection device 300 includes a first fluid ejection chamber 302 with a corresponding drop ejecting element 304, and a second fluid ejection chamber 303 with a corresponding drop ejecting element 305, such that nozzle openings or orifices 312 and 313 communicate with respective fluid ejection chambers 302 and 303. In one example, nozzle openings or orifices 312 and 313 are each of the same shape and size. In addition, drop ejecting elements 304 and 305 are each of the same shape and size. Although illustrated as being of the same shape and same size, nozzle openings or orifices 312 and 313, and drop ejecting elements 304 and 305, may be of different shapes, and may be of different sizes.

Similar to fluid ejection device 200, fluid ejection device 300 includes a fluid circulation path or channel 320 with a corresponding fluid circulating element 322. Similar to fluid circulating element 222, fluid circulating element 322 is provided in, provided along, or communicated with fluid circulation channel 320, and forms or represents an actuator to pump or circulate (or recirculate) fluid through fluid circulation channel 320. In one example, and as further described below, fluid circulating element 322 is laterally adjacent and between fluid ejection chamber 302 and fluid ejection chamber 303. In other examples, a position of fluid circulating element 322 may vary along fluid circulation channel 320.

In one example, and as illustrated in FIG. 3, fluid circulation channel 320 includes a path or channel portion 330 communicated with fluid feed slot 308, a path or channel portion 332 communicated with fluid ejection chamber 302, and a path or channel portion 334 communicated with fluid ejection chamber 303. As such, in one example, fluid in fluid circulation channel 320 circulates (or recirculates) between fluid feed slot 308 and fluid ejection chambers 302 and 303 through channel portion 330 and respective channel portions 332 and 334.

Similar to fluid circulation channel 220 of fluid ejection device 200, fluid circulation channel 320 of fluid ejection device 300 forms a fluid circulation (or recirculation) loop between fluid feed slot 308 and fluid ejection chambers 302 and 303. For example, fluid from fluid feed slot 308 circulates (or recirculates) through fluid ejection chamber 302 and through fluid ejection chamber 303 back to fluid feed slot 308. More specifically, fluid from fluid feed slot 308 circulates (or recirculates) through channel portion 330, through channel portion 332 and channel portion 334, and through fluid ejection chamber 302 and fluid ejection chamber 303 back to fluid feed slot 308.

In addition, and similar to fluid circulating element 222 of fluid ejection device 200, fluid circulating element 322 is formed in, provided within, or communicated with channel portion 330 of fluid circulation channel 320. As such, in one example, channel portion 330 directs fluid in a first direction, as indicated by arrow 330*a*, and channel portion 332 and channel portion 334 each direct fluid in a second direction opposite the first direction, as indicated by arrow 332*b* and arrow 334*b*. Thus, in one example, fluid circulating element 322 creates an average or net fluid flow in fluid circulation channel 320 between fluid feed slot 308 and fluid ejection chambers 302 and 303.

In one example, to provide fluid flow in the first direction indicated by arrow 330*a*, and the second, opposite direction indicated by arrow 332*b* and arrow 334*b*, fluid circulation channel 320 includes a channel loop 331 and a channel loop 333. As such, in one example, fluid circulation channel 320 directs fluid in the first direction (arrow 330*a*) between fluid feed slot 308 and channel loops 331 and 333, and in the second direction (arrow 332*b* and arrow 334*b*) between channel loop 331 and fluid ejection chamber 302 and between channel loop 333 end fluid ejection chamber 303. In one example, channel loop 331 includes a U-shaped portion of fluid circulation channel 320, and channel loop 333 includes a U-shaped portion of fluid circulation channel 320.

As illustrated in the example of FIG. 3, an array or series of fluid ejection devices 300 is provided along a length of fluid feed slot 308. More specifically, one fluid ejection device 300 including fluid circulation path 320 with corresponding fluid circulating element 322, fluid ejection chamber 302 with corresponding drop ejecting element 304, and fluid ejection chamber 303 with corresponding drop ejecting element 305 is laterally adjacent another fluid ejection device 300 including fluid circulation path 320 with corresponding fluid circulating element 322, fluid ejection chamber 302 with corresponding drop ejecting element 304, and fluid ejection chamber 303 with corresponding drop ejecting element 305 along one side of fluid feed slot 308. In one example, fluid ejection devices 300 are arranged on opposite sides of fluid feed slot 308 such that corresponding nozzle openings or orifices 312 and 313 of fluid ejection devices 300 are arranged in parallel (substantially parallel) columns (or arrays).

As illustrated in the example of FIG. 2, fluid circulating element 222 is laterally adjacent fluid ejection chamber 202, and fluid ejection chamber 202 is laterally adjacent fluid ejection chamber 203. More specifically, fluid circulating element 222 is positioned to one side of fluid ejection chamber 202 along fluid feed slot 208, and fluid ejection chamber 202 is positioned to one side of fluid ejection chamber 203 such that fluid ejection chamber 202 is positioned between fluid circulating element 222 and fluid ejection chamber 203 along fluid feed slot 208. In addition, as illustrated in the example of FIG. 3, fluid circulating element 322 is laterally adjacent fluid ejection chamber 302 and laterally adjacent fluid ejection chamber 303. More specifically, fluid circulating element 322 is positioned to one side of fluid ejection chamber 302 and positioned to one side of fluid ejection chamber 303 such that fluid circulating element 322 is positioned between fluid ejection chamber 302 and fluid ejection chamber 303 along fluid feed slot 308.

As such, and as illustrated in the example of FIG. 2, fluid ejection chamber 202 and fluid ejection chamber 203 of fluid ejection device 200 are laterally adjacent to each other, and as illustrated in the example of FIG. 3, fluid ejection chamber 303 of one fluid ejection device 300 and fluid ejection chamber 302 of an adjacent fluid ejection device 300 are laterally adjacent to each other. Accordingly, drop ejecting element 204 and drop ejecting element 205 of fluid ejection device 200 may be operated separately or individually at different moments of time to produce drops of the same size (weight), or operated substantially simultaneously to produce a combined drop of a combined size (weight). In addition, drop ejecting element 304 of one fluid ejection device 300 and drop ejecting element 305 of an adjacent fluid ejection device 300 may be operated separately or individually at different moments of time to produce drops of the same size (weight), or operated substantially simultaneously to produce a combined drop of a combined size (weight).

Figure 4C:
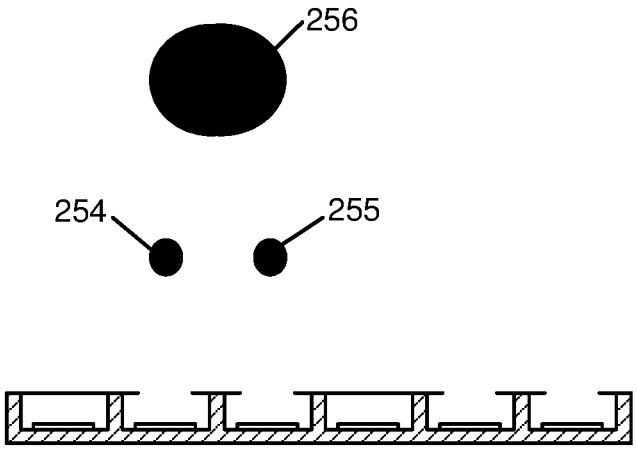
FIGS. 4A, 4B, 4C are schematic cross-sectional views illustrating an example of operation of the fluid ejection device of FIG. 2.
Figure 4B:
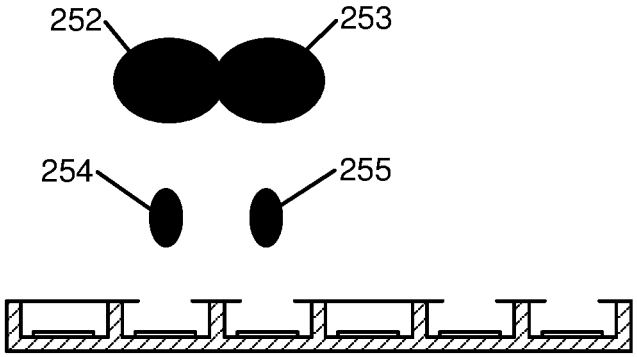
Figure 4A:
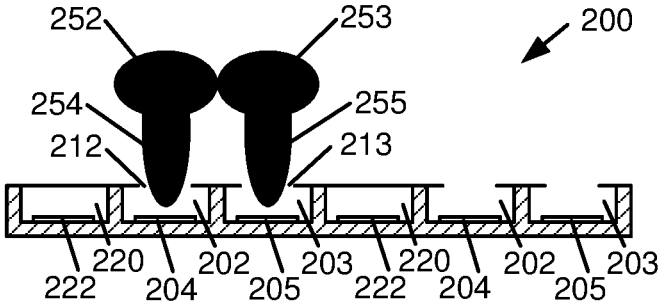

More specifically, in one example, as illustrated in FIGS. 4A, 4B, 4C, laterally adjacent drop ejecting elements 204 and 205 of fluid ejection device 200 (with laterally adjacent fluid circulating element 222 in fluid circulation channel 220) are operated substantially simultaneously to produce a combined drop of a combined size (weight). For example, as illustrated in FIG. 4A, substantially simultaneous ejection of fluid from fluid ejection chambers 202 and 203 (through respective nozzles 212 and 213) results in individual drops 252 and 253 (with respective tails 254 and 255) being formed. Subsequently, as illustrated in FIG. 4B, individual drops 252 and 253 begin to merge (and tails 254 and 255 break off). Thereafter, as illustrated in FIG. 4C, a single, merged drop 256 is formed (with tails 254 and 255 dissipating).

Figure 5C:
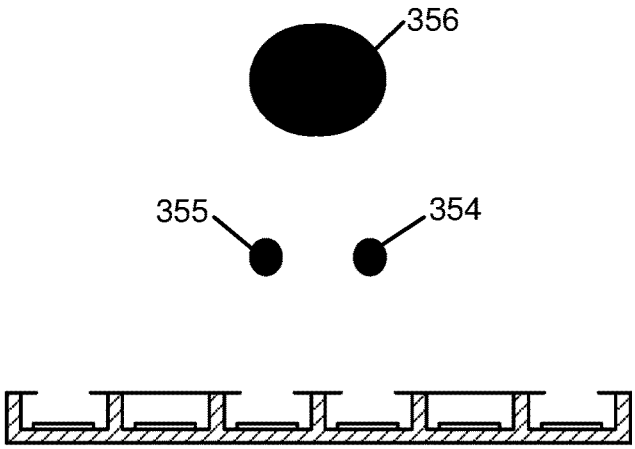
FIGS. 5A, 5B, 5C are schematic cross-sectional views illustrating an example of operation of the fluid ejection device of FIG. 3.
Figure 5B:
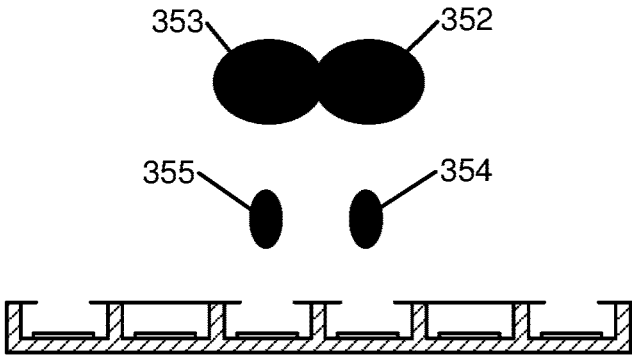
Figure 5A:
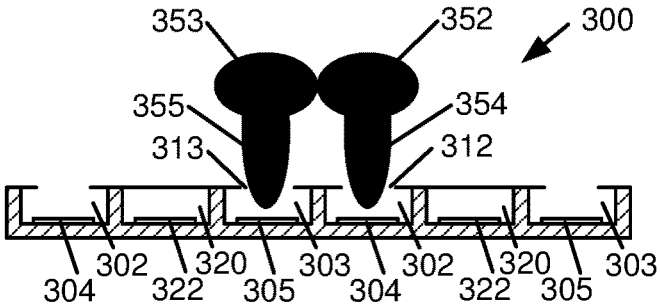

In addition, in one example, as illustrated in FIGS. 5A, 5B, 5C, drop ejecting element 305 of one fluid ejection device 300 (with laterally adjacent fluid circulating element 322 in fluid circulation channel 320) and laterally adjacent drop ejecting element 304 of an adjacent fluid ejection device 300 (with laterally adjacent fluid circulating element 322 in fluid circulation channel 320) are operated substantially simultaneously to produce a combined drop of a combined size (weight). For example, as illustrated in FIG. 5A, substantially simultaneous ejection of fluid from fluid ejection chambers 303 and 302 (through respective nozzles 313 and 312) results in individual drops 353 and 352 (with respective tails 355 and 354) being formed. Subsequently, as illustrated in FIG. 5B, individual drops 353 and 352 begin to merge (and tails 355 and 354 break off). Thereafter, as illustrated in FIG. 5C, a single, merged drop 356 is formed (with tails 355 and 354 dissipating).

Figure 6:
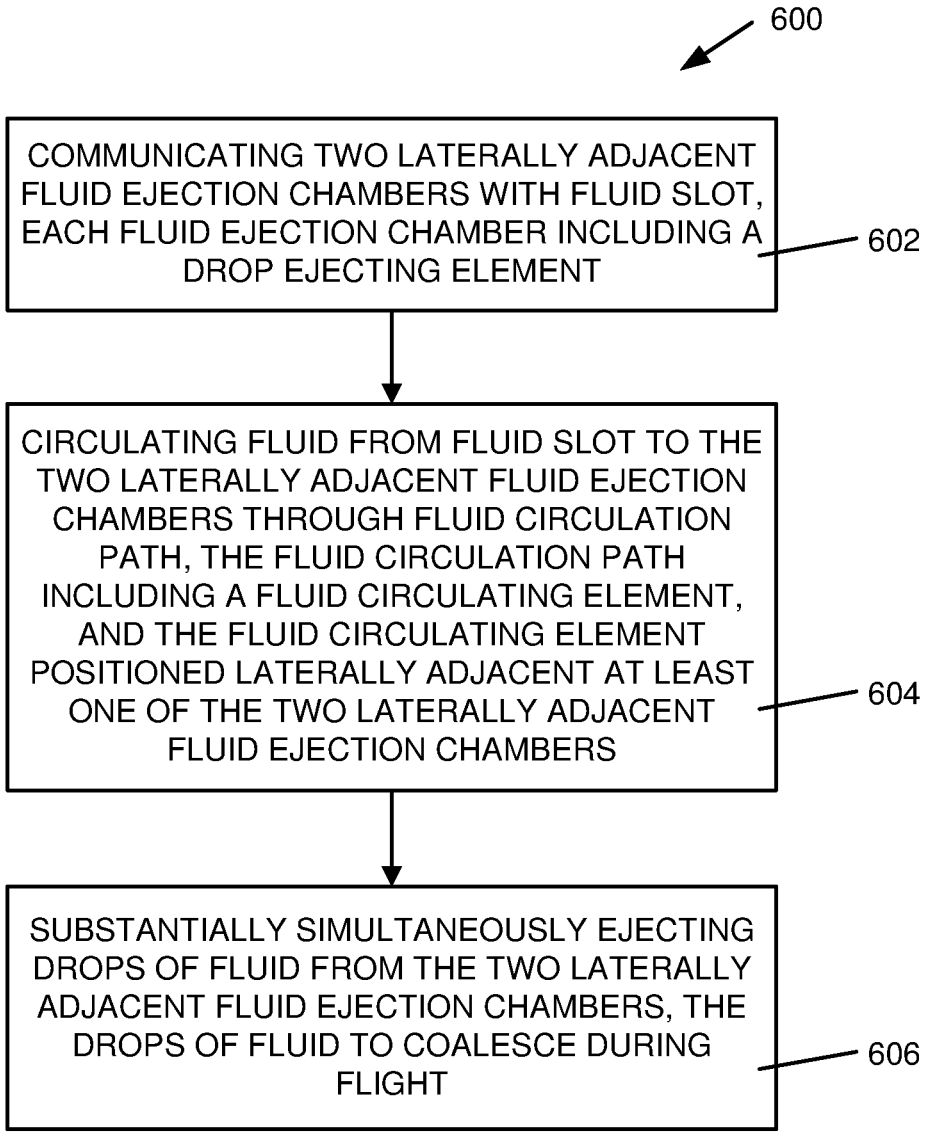
FIG. 6 is a flow diagram illustrating an example of a method of operating a fluid ejection device.

FIG. 6 is a flow diagram illustrating an example of a method 600 of operating a fluid ejection device, such as fluid ejection device 200, 300 as illustrated in the respective examples of FIGS. 2, 3 and FIGS. 4A, 4B, 4C and 5A, 5B, 5C.

At 602, method 600 includes communicating two laterally adjacent fluid ejection chambers with a fluid slot, with each of the two laterally adjacent fluid ejection chambers including a drop ejecting element, such as fluid ejection chambers 202/203, 303/302 including respective drop ejecting elements 204/205, 305/304 communicating with respective fluid feed slots 208, 308.

At 604, method 600 includes circulating fluid from the fluid slot to the two laterally adjacent fluid ejection chambers through a fluid circulation path, with the fluid circulation path including a fluid circulating element, and the fluid circulating element positioned laterally adjacent at least one of the two laterally adjacent fluid ejection chambers, such as fluid from respective fluid feed slots 208, 308 circulating to respective fluid ejection chambers 202/203, 303/302 through respective fluid circulation paths or channels 220, 320 including respective fluid circulating elements 222, 322.

At 606, method 600 includes substantially simultaneously ejecting drops of fluid from the two laterally adjacent fluid ejection chambers, wherein the drops of fluid are to coalesce during flight, such as individual drops 252/253, 353/352 ejecting from respective fluid ejection chambers 202/203, 303/302 and combining as respective merged drops 256, 356.

Although illustrated and described as separate and/or sequential steps, the method of forming the fluid ejection device may include a different order or sequence of steps, and may combine one or more steps or perform one or more steps concurrently, partially or wholly.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection device, comprising:

a fluid slot;

four fluid ejection chambers, each fluid ejection chamber having an individually-operable drop ejecting element therein, wherein the four fluid ejection chambers are unevenly spaced along a length of the fluid slot;

two fluid circulation paths communicated with the fluid slot, each fluid circulation path communicated with two of the four fluid ejection chambers; and two fluid circulating elements, distinct from the individually-operable drop ejecting elements, within the two fluid circulation paths, the fluid circulating element laterally adjacent and between the two fluid ejection chambers communicated with the same fluid circulation path, wherein one fluid ejection chamber communicated with one of the two fluid circulation paths is laterally adjacent another fluid ejection chamber that is communicated with the other one of the two fluid circulation paths, and the two laterally adjacent fluid ejection chambers are to substantially simultaneously eject drops of fluid therefrom, wherein the drops of fluid are to coalesce during flight.

2. The fluid ejection device of claim 1, wherein each of the two fluid circulation paths includes a first portion to direct fluid in a first direction from the fluid slot, a second portion to direct fluid in a second direction opposite the first direction to both of the two fluid ejection chambers communicated with the same fluid circulation path, and a channel loop between the first portion and the second portion.

3. The fluid ejection device of claim 1, wherein each of the two fluid circulation paths includes a first portion to direct fluid in a first direction from the fluid slot, a second portion to direct fluid in a second direction opposite the first direction to a first of the two fluid ejection chambers communicated with the same fluid circulation path, a third portion to direct fluid in the second direction opposite the first direction to a second of the two fluid ejection chambers communicated with the same fluid circulation path, a first channel loop between the first portion and the second portion, and a second channel loop between the first portion and the third portion.

4. A fluid ejection device, comprising:

a fluid slot;

a plurality of fluid ejection chambers each fluid ejection chamber communicated with the fluid slot and having a individually-operable drop ejecting element, including at least a first fluid ejection chamber having a first individually-operable drop ejecting element, a second fluid ejection chamber having a second individually-operable drop ejecting element, a third fluid ejection chamber having a third individually-operable drop ejecting element, and a fourth fluid ejection chamber having a fourth individually-operable drop ejecting element, wherein the plurality of fluid ejection chambers are unevenly spaced along a length of the fluid slot;

a plurality of fluid circulation paths communicated with the fluid slot and the plurality of the fluid ejection chambers, including the first fluid ejection chamber and the second fluid ejection chamber communicated with a first fluid circulation path, and the third fluid ejection chamber and the fourth fluid ejection chamber communicated with a second fluid circulation path; and a plurality of fluid circulating elements, distinct from the individually-operable drop ejecting elements, within the plurality of fluid circulation paths, wherein each fluid circulating element is laterally adjacent and between the two fluid ejection chambers communicated with the same fluid circulation path, wherein one fluid ejection chamber communicated with one of the plurality of fluid circulation paths is laterally adjacent another fluid ejection chamber communicated with another one of the plurality of fluid circulation paths, and the two laterally adjacent fluid ejection chambers are to substantially simultaneously eject drops of fluid, wherein the drops of fluid are to coalesce in flight.

5. The fluid ejection device of claim 4, wherein each fluid circulation path includes a first portion to direct fluid in a first direction from the fluid slot, a second portion to direct fluid in a second direction opposite the first direction to a first of the two fluid ejection chambers communicated with the same fluid circulation path, a third portion to direct fluid in the second direction opposite the first direction to a second of the two fluid ejection chambers communicated with the same fluid circulation path, a first channel loop between the first portion and the second portion, and a second channel loop between the first portion and the third portion.

6. A method of operating a fluid ejection device, comprising:

communicating four fluid ejection chambers with a fluid slot, each of the four fluid ejection chambers including a individually-operable drop ejecting element;

circulating fluid from the fluid slot to the four fluid ejection chambers through two fluid circulation paths, each fluid circulation path including a fluid circulating element distinct from the individually-operable drop ejecting element, and each fluid circulating element positioned laterally adjacent and between the two fluid ejection chambers communicated with the same fluid circulation path; and substantially simultaneously ejecting drops of fluid from the two laterally adjacent fluid ejection chambers communicated with two different fluid circulation paths, wherein the drops of fluid are to coalesce during flight.

7. The method of claim 6, wherein circulating fluid includes circulating fluid from the fluid slot to the four fluid ejection chambers through the two fluid circulation paths.

8. The fluid ejection device of claim 1, wherein each of the individually-operable drop ejecting elements comprises a resistor or a piezoelectric actuator.

9. The fluid ejection device of claim 4, wherein each of the individually-operable drop ejecting elements comprises a resistor or a piezoelectric actuator.

10. The method of claim 6, wherein each of the individually-operable drop ejecting elements comprises a piezoelectric actuator, a resistor, an electrostatic (MEMS) membrane, a mechanical/impact driven membrane, a voice coil, or a magneto-strictive drive.

* * * * *